US005845506A

United States Patent [19]

Jobmann

[11] Patent Number: 5,845,506

[45] Date of Patent: Dec. 8, 1998

[54] DRINK DISPENSER WITH IMPROVED COOLING

[75] Inventor: Wolfgang Jobmann, Hamburg, Germany

[73] Assignee: Wolfgang Jobmann GmbH, Germany

[21] Appl. No.: 682,735

[22] PCT Filed: Dec. 1, 1995

[86] PCT No.: PCT/DE95/01704

§ 371 Date: Jul. 30, 1996

§ 102(e) Date: Jul. 30, 1996

[87] PCT Pub. No.: WO96/16895

PCT Pub. Date: Jun. 6, 1996

[30] Foreign Application Priority Data

Dec. 2, 1994 [DE] Germany ..... 44 43 009.4
Jan. 11, 1995 [DE] Germany ..... 195 01 238.0

[51] Int. Cl.[6] ..... B67D 5/62

[52] U.S. Cl. ..... 62/98; 62/339; 222/146.6

[58] Field of Search ..... 62/393, 389, 342, 62/315, 98; 222/146.6

[56] References Cited

U.S. PATENT DOCUMENTS

| | | | |
|---|---|---|---|
| 1,709,486 | 4/1929 | Ratterman | 62/315 |
| 2,231,329 | 2/1941 | Goll | 62/144 |
| 2,513,610 | 7/1950 | Williams | 62/393 |
| 2,608,837 | 9/1952 | Leland | 62/393 |
| 4,293,082 | 10/1981 | Matsueda | 222/146.6 |
| 4,429,549 | 2/1984 | Randolphi | 62/342 |
| 4,563,880 | 1/1986 | Cipelletti | 62/342 |

FOREIGN PATENT DOCUMENTS

| | | |
|---|---|---|
| 1338649 | 10/1962 | France . |
| 7403066 | 5/1974 | Germany . |
| 7838836 | 12/1978 | Germany . |
| 1117743 | 5/1989 | Japan . |
| 4311495 | 11/1992 | Japan . |
| WO9427908 | 12/1994 | WIPO . |

*Primary Examiner*—William E. Tapolcai
*Attorney, Agent, or Firm*—Eckert Seamans Cherin & Mellott

[57] ABSTRACT

The invention relates to drink dispensers, particularly such dispensers in which the drink is stored in readily mixed or premixed form in a reservoir. The invention provides an improved heat or cold transmission for such dispensers. The thermal conduction between the bottom of the reservoir and a cooling plate provided in the base is improved by a freezing liquid introduced between the bottom and the cooling plate. The thermal conduction is particularly homogenized and improved by providing a cellulose layer between the reservoir bottom and the cooling plate, the layer taking up or absorbing the liquid.

13 Claims, 4 Drawing Sheets

DRINK DISPENSER WITH IMPROVED COOLING

FIELD OF THE INVENTION

The invention relates to refrigerated storage reservoirs for drinks, also called "dispensers", particularly to such dispensers keeping or storing the drink in readily mixed form in a reservoir, to be taken out at refrigerated temperature by a user as required ("premix apparatus").

BACKGROUND

In a "premix apparatus" as dispenser, i. e. the storage reservoir is filled with a ready to drink beverage consisting for example of 1 part concentrate and 9 parts water, the drink is cooled down by a built-in cooling apparatus and held at the desired temperature by a thermostat. The drink is continuously stirred to on one hand distribute the temperatures and on the other hand to avoid that pulp particles deposit on the top. For this purpose, a magnetically coupled stirring device may be provided in said reservoir. Other apparatuses have stirring motors or pumps. DE-A 78 38 836 describes a "postmix apparatus" (the drink mixture is prepared only upon requiring a drink, e.g. in a mixing channel) comprising a carbonizer (reservoir for carbonized water, also being distributable as drink) and a cooling apparatus. Said carbonizer is firmly installed on an intermediate bottom and—according to the Figure—probably cooled by direct contact from the bottom or by cooling spirals directly engaging in the carbonizer.

SUMMARY

With the invention, better thermal conduction between a drink reservoir and a refrigerating source is to be achieved.

A liquid film, particularly a water film, which is provided between the cooling plate of the low-temperature conveyance section and the reservoir bottom, which is at least segmentally heat-conductive, which film freezes in operation, allows a superior transmission of the cold to be conveyed into the reservoir or the heat to be extracted from said reservoir. Said low-temperature conveyance section is supplied by a cooling apparatus. According to one embodiment, said reservoir is removable.

Ice as liquid freezing in operation has an even better thermal conductivity than water. Thus, together with said reservoir bottom and said cooling plate, a layered bottom is obtained, providing ideal thermal conduction and additionally being inexpensive. Unevennesses are almost completely compensated for and, additionally, an increased contact pressure between said removable reservoir and said cooling unit is achieved by the volume expansion of the frozen water, to further improve the heat or cold thermal conduction. In concrete terms:

(a) water may be filled into a center recess (contoured area) of said cooling plate. When installing the drink reservoir, the water is evenly distributed between the bottom of said reservoir and said plate to constitute a liquid film; or (b) a moistened absorbent cellulose layer, particularly an intermediate textile or paper layer, may be inserted into said reservoir bottom from its underside or laid upon the cooling plate. Said intermediate layer consists of a highly absorbent material to store as much liquid as possible. Thus, said liquid film is long-term homogenized and said water/ice is retained in the area of said cooling plate. If, in case of the sole use of freezing liquid, slight unevennesses still remains, said cellulose layer provides full surface contact and complete homogenization of the liquid which is still flowable before it freezes with said cellulose layer. Thus, inclusion of air bubbles is substantially avoided.

Thus, thermal conduction is substantially improved and unevennesses are compensated for. If said absorbent layer slightly protrudes on the edges (claim 4), it has the possibility to continuously renew its content of water and, thus, the water film in said "layered bottom", as it is supplied by condensed water dropping down—from the refrigerated reservoir. Evaporization or volatilization in switched-off condition is avoided.

Due to said better heat conduction, the cooling performance of said cooling apparatus is also yielded very quickly into the drink, so that correspondingly long on- and off-times improve the working life of said cooling apparatus. This is particularly noticeable in case of bottom/reservoir sections being geometrically shaped to fit together (claim 10, 11).

Thus, not only a quick refrigeration of the product for sales reasons and an improved stability of the product are achieved, but also protection of said cooling apparatus is provided.

Said cooling apparatus is controlled by an adjustable thermostat, the temperature detector of which being integrated in said cooling plate. Said cooling plate is generally controlled in minus temperatures. Switch-on and switch-off positions may for example be −5° C. (on) and −20° C. (off). It is advantageous for the lifetime of said cooling apparatus that for example a certain dormant period is observed after switching-off, so that the pressure of the cooling agent built up in said apparatus may be reduced. If this is not the case, the cooling compressor has to start under heavy load. For starting a cooling compressor, an auxiliary winding in the compressor motor is connected via a thermal switch. If the pressure in said aggregate is still too high, said thermal switch immediately switches off again, because the motor does not start under heavy load, and the sequence starts from the beginning. The starting attempts are repeated in short intervals until the pressure in the cooling system is reduced and the compressor motor finally starts. Long off- and on-times achieved with the invention avoid said repeated heavy loading of the compressor motor.

The invention also provides a basis to improve the hygienic aspects of dispensers. Instead of a drink reservoir open on the bottom and on the top, a substantially, completely closed, removable drink reservoir may be used according to one aspect of the invention. The only exceptions to such complete closure are an outlet opening and a filter, through which—when drink is dispensed—clean (sterile) air is conveyed to avoid low-pressure in said reservoir.

In the center of the cover of the reservoir, according to another aspect of the invention, the possibility is provided on one hand to filter the germs off the air with the help of a micro filter as filter for single use or filter for multiple use with corresponding pore width and size and, on the other hand, to be permeable to the corresponding quantity of ultrafine filtered air which is transmitted in amounts corresponding to the quantity of drink dispensed. Likewise, an activated carbon filter may be used, even with silvered coal.

A further advantage of the drink reservoir being closed on the top and on the bottom is that drink may be introduced for example at a central place and in a sterile and hygienic manner, even if the basic apparatus including the base with cooling apparatus normally is mounted in a snack bar, on the corridor or, for example, in tea kitchens of individual departments of a hospital, where the low-temperature conveyance section usually is cleaned with "dishcloth and bucket". Dishcloths are little hygienic and mostly full of germs because anything possible is wiped with them. Thus, when cleaning the low-temperature conveyance section (a vertical cylindrical column over which the reservoir with bottom opening and gasket would be put or a cooling plate on which the reservoir would be put) as substantial parts of the drink reservoir are already inoculated with germs which are then transferred into the drink. This hygienic problem is avoided with a substantially completely closed—entirely removable—reservoir. The low-temperature conveyance section conveying the refrigeration to the drink is no longer part of the drink reservoir and therefore does not get in direct contact with the drink; said low-temperature conveyance section remains isolated.

With the above described invention, all roughness and misfits between the cooling plate and reservoir bottom are completely compensated and a transmission of cooling power is achieved which corresponds to that of a drink reservoir directly installed on said plate, however without the hygienic problems of directly attaching open reservoirs. Therefore, both, good thermal conveyance and also hygiene are achieved with the invention.

A further technical improvement on the apparatus and the dispensing mechanism is a transparent cover of the outlet tube (nozzle), prohibiting direct contact of said part when drink is dispensed (claim 12). The cover is transparent, so that in the dispensing area, the drinking vessel may be positioned correctly with respect to the clearly visible outlet tube.

The invention is described in detail by schematic drawings on the basis of illustrative embodiments.

DESCRIPTION OF ILLUSTRATIVE EMBODIMENTS

Figure 1:
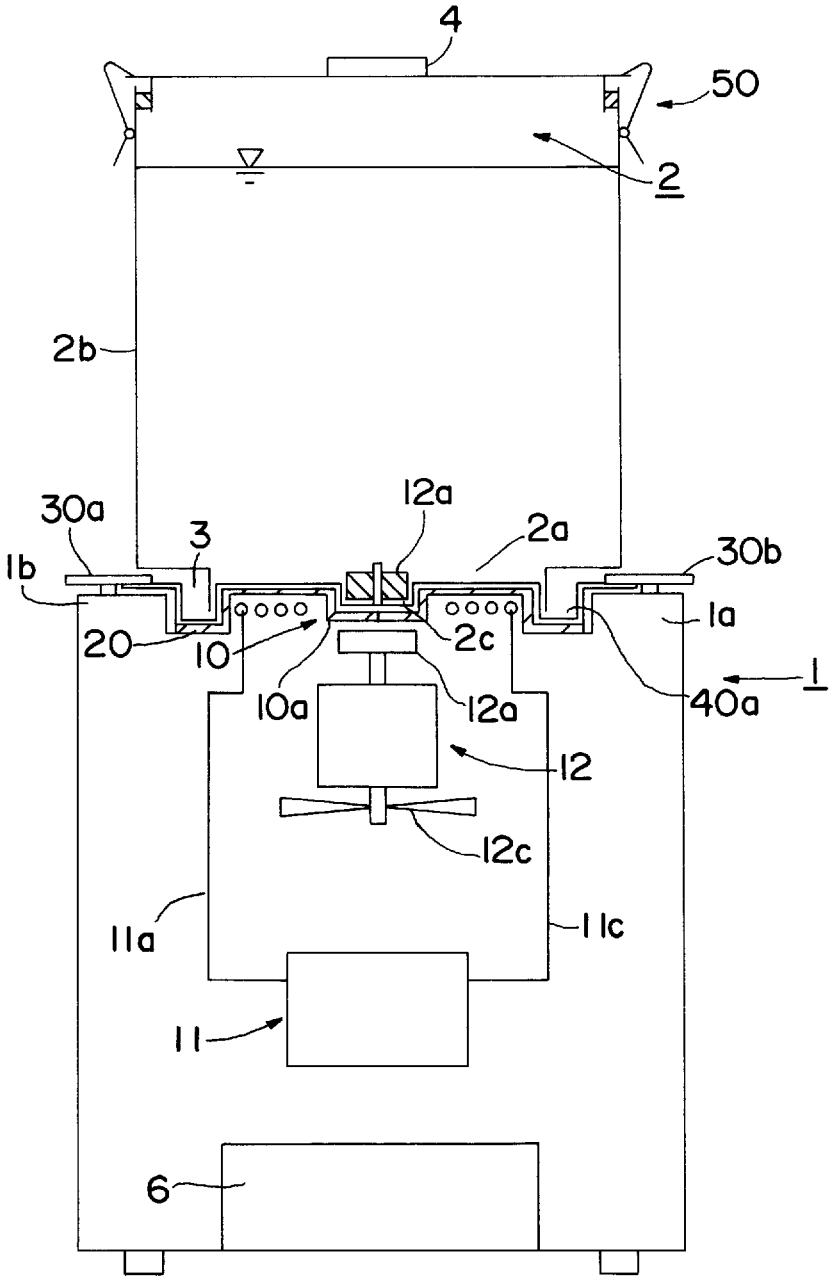
FIG. 1 is a schematic front view of a drink dispenser incorporating the principles of the present invention.
Figure 1A:
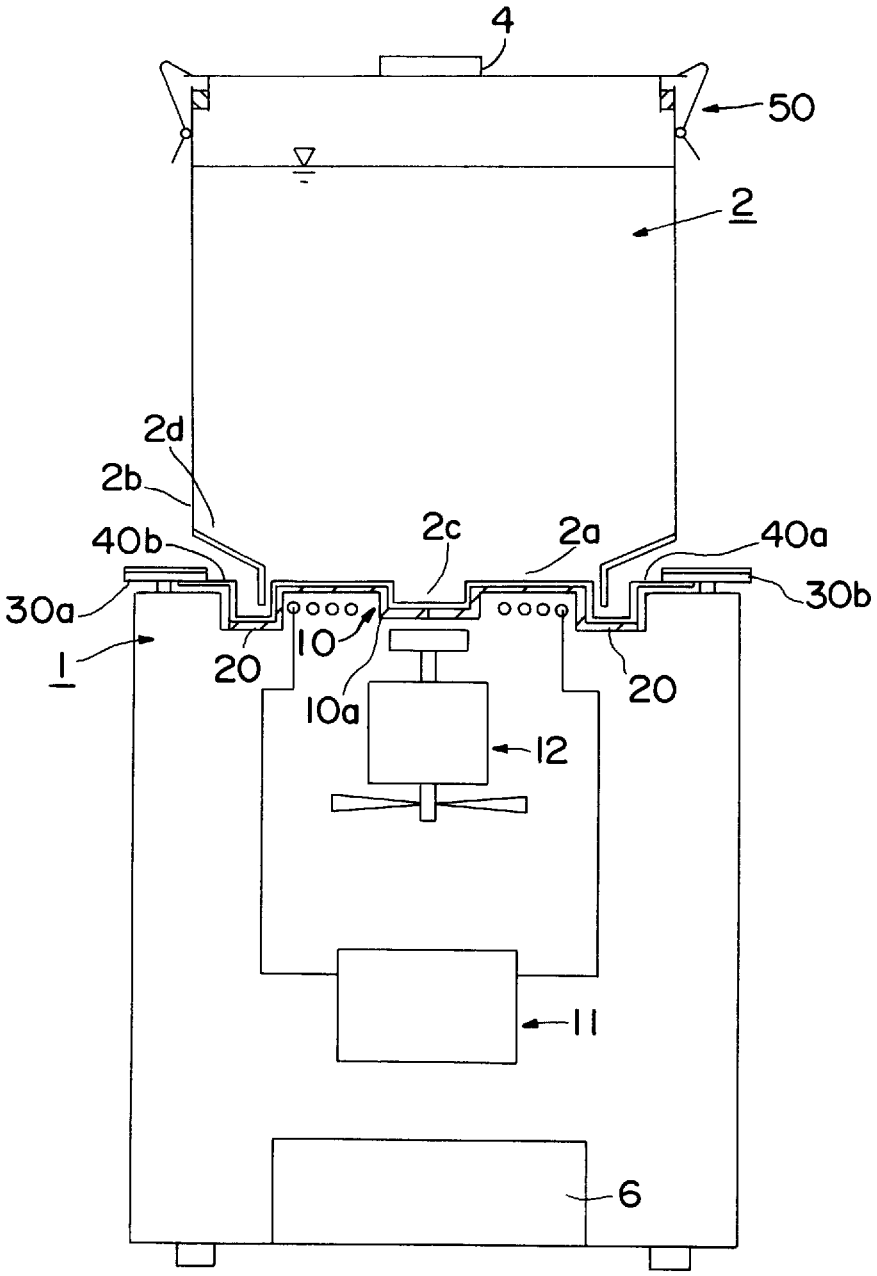
FIG. 1*a* is an alternative embodiment of the drink dispenser of FIG. 1.
Figure 1B:
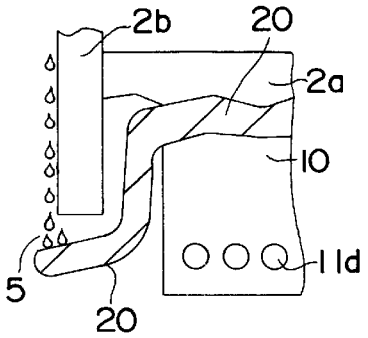
FIG. 1*b* is an enlarged sectional view of a portion of the embodiments of FIGS. 1 and 1*a;*

FIGS. 1 and 1*a* illustrate the front side of a drink dispenser which is filled with a drink (in a reservoir 2), and which includes a cooling apparatus 11. Said reservoir sits on a base 1 which is provided with a recess 3 surrounded by a collar 1*a,*1*b.* In said recess, a cooling plate 10 is provided having a center 10*a* and a surrounding annular section 10*b,* which together comprise the low-temperature conveyance section. On the bottom side or in said cooling plate 10, cooling spirals 11*d* are inserted, which spirals are shown in FIG. 1*b.* Instead of cooling spirals 11*d,* a hydrodynamic flow cooling or a connector cooling from said cooling apparatus 11 with fan 12*c,* directed to said cooling plate 10 may also be provided.

Said fan is coupled to a motor 12, actuating a magnetic stirring device 12*a,*12*b.*

The drink outlet is located above a drop collecting vessel 6 and is supplied from a flexible tube, protruding from said reservoir 2 in downward direction.

Said reservoir 2 is made of a transparent but rigid plastic material. On the upper side of said reservoir 2, a filter 4 is located, through which air L may stream. The volume of said transferred air L is dimensioned such that it replaces in said reservoir 2 the volume of the drink withdrawn through said tube (which is not shown). Thus, low-pressure is avoided.

On the upper end, said reservoir is provided with a firmly/tightly lockable cover with clamps 50.

Said reservoir 2 has circumferential walls 2*b;* it may have the shape of a box. According to FIG. 1*a,* said box-type design may have complete or sectional circumferential slopes 2*d* which form a bevel on its lower section. The bottom plate 2*a* of said reservoir is heat-conductive, e.g. made of stainless steel (NIRO-steel) or an other stainless metal having good thermal conductivity. Said bottom plate 2*a* is firmly connected to said reservoir wall 2*b.*

On the edges, said wall 2*b* of said reservoir 2 engages in said recess 3 of said base 1 and slightly projects over said bottom plate 2*a* in downward direction. Thus, condensed water may be collected radially inside said circumferential collar 1*a,*1*b* (FIG. 1). Due to the sloped wall shape 2*d* (FIG. 1*a*) condensed water 5 may also be collected even in the case of broader reservoirs 2, as schematically shown in FIG. 1*b.*

Between said bottom 2*a* and said cooling plate 10, a layer of formed fabric or cellulose tissue 20 is provided. Said layer stores a liquid which freezes by operation of said cooling plate 10, and good layer creates a good contact between the surface—which may be rough—of said cooling plate 10 and the lower surface of said bottom 2*a.* Therefore, said bottom does not have to be particularly processed or particularly smooth, because this is compensated for by said absorbent layer 20.

Instead of or with said absorbent layer, a liquid, such as water, may also be used, which liquid freezes in operation directly on the surface of said cooling plate 10. For this purpose, a depression or pot-shaped recess 10*a* may be provided in the middle of a round cooling plate 10, which recess faces a corresponding elevation 2*c* of said bottom 2*a* on the side of said reservoir 2. A quantity of water may be filled in said recess 10*a,* which quantity depends on the depth of said recess 10*a* and on the size of the surface 10 and which is distributed when said reservoir 2 is put on said cooling plate 10 or when said shaped absorbent layer (such as collar) is inserted. Said downward protruding elevation 2*c* of said bottom 2*a* presses the water out of said recess 10*a* of said cooling plate 10 and distributes it evenly on said plate 10, if said distributing task has not yet been taken over by said cellulose layer 20.

The physical property of the liquid has to be such that the liquid freezes in operation of said cooling plate 10, i. e. between −5° C. and about −20° C., if necessary begins to freeze even at higher temperatures without being frozen already at room temperature. As a result, it is easily introducible and has good heat-conduction property during the (refrigerating) operation.

Figure 2:
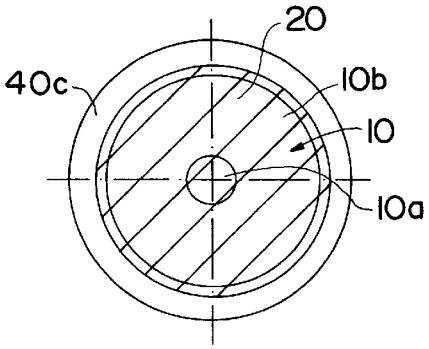
FIG. 2 is a top plan view of the cooling plate according to one aspect of the present invention.
Figure 2A:
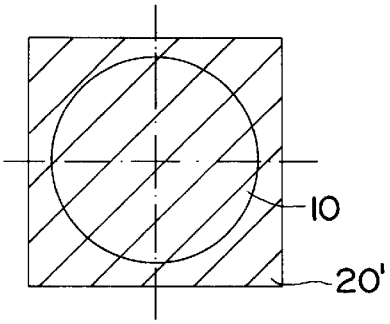
FIGS. 2*a,* 2*b,* 2*c,* and 2*d* are alternative cellulose covers for use in the drinking dispensers of the present invention.

The cellulose layer 20 according to FIG. 1 and FIG. 1*a* is illustrated in detail in FIG. 2 as well as in FIGS. 2*a,*2*b,*2*c* and 2*d* in several embodiments.

FIG. 2 is a top plan view of the cooling section 10, which in this embodiment is circular. In the middle, said recess 10*a* is provided, surrounded by an annular recess 10*c,* which corresponds to recess 3 of FIG. 1, and between said recesses, the annular plateau 10*b* is located.

Therefore, said layer 20 of absorbent material has also a circular shape. It slightly protrudes over the contact area 10*b* of said cooling plate 10, so that it is in a position to contact the edge areas protruding in downward direction of said reservoir walls 2*b* from downside or to be at least near them. Condensed water, which is built on the outer side of the cooled reservoir 2 may thus be taken up by said absorbent material 20. This is illustrated in FIG. 1*a* showing the edge area of said cooling plate 10. Above said plate 10, the metallic bottom area 2*a*—with good heat conduction—is provided, having (excessively illustrated) unevennesses. The outer edge area of said absorbent layer 20 protrudes over the downward projecting edge of said wall 2*b,* so that the water drops 5 may be taken up.

If said absorbent layer 20' has square form, as shown in FIG. 2*a,* water drops 5 may only be taken up in the corner sections, in which the absorbent layer extends beyond the circular cooling plate 10.

Figure 2B:
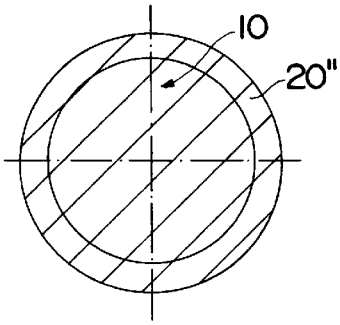

FIG. 2*b* features the embodiment of FIG. 2 and shows more in detail the radial enlargement of said absorbent layer 20" to be able to circumferentially take up dropping water 5. An inner recess 2*a* is not provided.

Figure 2C:
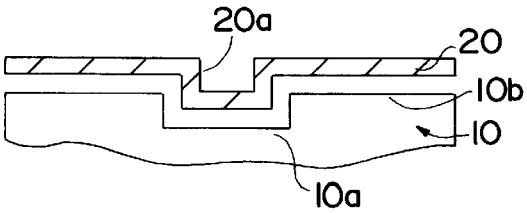

Finally, FIG. 2*c* shows a contoured absorbent layer 20 (as shaped collar), such as also illustrated in FIG. 1 and 1*a*. Corresponding to said contour 20*a,* said cooling plate 10 is provided with a center recess 10*a*.

Figure 2D:
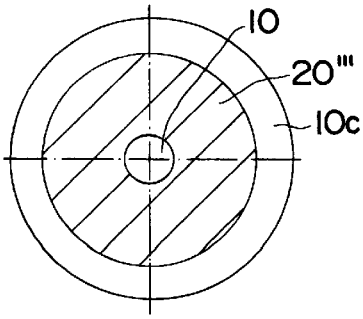

FIG. 2*d* shows an absorbent layer 20''' with a center opening, facilitating the spreading of the water stored in said center recess into said absorbent layer 20'''.

Figure 3:
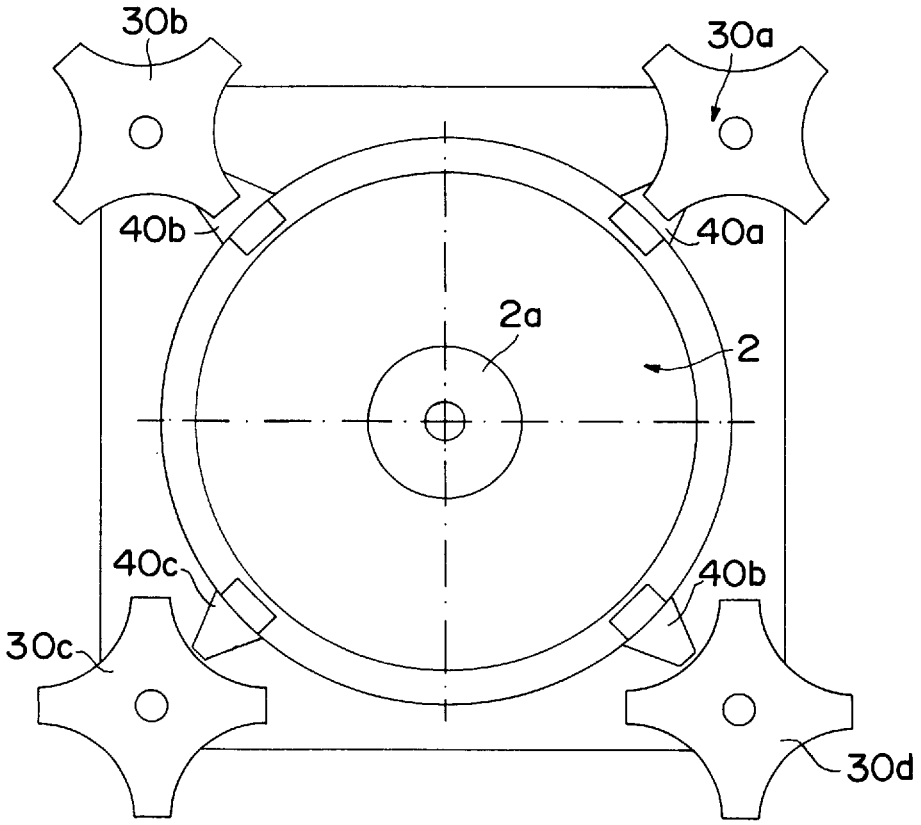
FIG. 3 is a top cross-sectional view of a reservoir in accordance with the present invention.

FIG. 3 illustrates the edge-side flanges 40*a,*40*b,*40*c,*40*d* (collectively, 40) on the underside of a reservoir 2, which flanges being releasably secured by rotatable star-shaped clamps 30*a,*30*b* . . . (collectively: 30). FIG. 3 is an approximately horizontal section at the level of said cooling plate 10 of FIG. 1*a*. The flanges 40 on the corners provide a locking possibility without impeding the access of condensed water 5 on the edges of said absorbent layer 30, which, for the rest, is pressed in. Said layer is contoured in vertical direction, adapted to said circular recess 10*c* inside the outer collars 1*a,*1*b* of said base 1.

I claim:

1. A dispenser for drink comprising:

a base having a low-temperature conveyance section therein;

a cooling apparatus operatively associated with the low-temperature conveyance section;

means for storing the drink, said storing means mounted on the base and operatively connected to the low-temperature conveyance section, the storing means having a bottom with a thermally conductive portion;

a liquid which freezes in operation, the liquid being introducible between the low-temperature conveyance section and the thermally conductive portion; and, an absorbent layer between said low-temperature conveyance section and said thermally conductive portion, said liquid being distributable free from air bubbles within said layer.

2. The drink dispenser according to claim 1, wherein said low-temperature conveyance section has a predetermined shape and said absorbent layer is a collar substantially adapted to the shape of said low-temperature conveyance section.

3. The drink dispenser according to claim 2, wherein said means for storing the drink includes an outer reservoir wall, and said low temperature conveyance section includes an edge, and wherein said absorbent layer has a portion which protrudes from said edge with respect to said low-temperature conveyance section to absorb about the circumference of said wall condensed water dropping from the outer reservoir wall.

4. The drink dispenser according to claim 3, wherein said absorbent layer is contoured as a shaped collar in transverse direction with respect to its main extension plane.

5. The drink dispenser according to claim 1, further comprising a filter, and wherein the storing means comprises a removable reservoir having an opening therein for dispensing drink, the filter connected to the surface of the reservoir and exposed to air so that when drink is dispensed through the opening, air flows through the filter, the reservoir being completely closed except for the filter passage and the opening.

6. The drink dispenser according to claim 5, wherein the bottom of said reservoir is completely closed, and said thermally conductive portion is made of stainless steel.

7. The drink dispenser according to claim 1, wherein said liquid which freezes in operation is water.

8. The drink dispenser according to claim 1, wherein the thermally conductive portion comprises the center of the bottom.

9. The drink dispenser according to claim 1, wherein said low-temperature conveyance section comprises a cooling plate, and wherein said bottom of said means for storing the drink is contoured to fit into a corresponding contour of said cooling plate.

10. The drink dispenser according to claim 9, wherein said bottom is provided with first steps disposed concentrically in relation to each other, and wherein said cooling plate is provided with second steps counter-oriented with respect to said first steps.

11. The drink dispenser according to claim 1, further comprising a downwardly extending outlet nozzle on said storing means and a transparent cover circumferentially protecting said outlet nozzle, the height of said cover being at least equal in size to said downwardly extending outlet nozzle.

12. In a drink dispenser having a cooling surface and a removable drink reservoir with a thermally conductive bottom, a process for improving thermal conduction between the cooling surface and the bottom comprising the steps of introducing a liquid between said bottom and said cooling surface;

providing an absorbent cellulose layer, wherein said liquid is storable in said absorbent layer;

introducing said liquid into said layer; and freezing said liquid to constitute a thermal conduction layer, whereby said absorbent layer and said frozen liquid together homogenizing and improving said thermal conduction.

13. In a drink dispenser having a cooling surface and a drink reservoir with a thermally conductive bottom, a process for improving thermal conduction between the cooling surface and the bottom comprising the steps of introducing a liquid between said bottom and said cooling surface to constitute a thermal conduction layer and freezing said liquid;

providing an absorbent cellulose layer, wherein said liquid is storable in said absorbent layer;

introducing said liquid into said layer, said absorbent layer and said frozen liquid together homogenizing and improving said thermal conduction;

compressing said absorbent layer by means of clamping elements on a base of the drink dispenser and flanges on the reservoir of the drink dispenser engaged by said clamping elements.

* * * * *